United States Patent [19]

Inagaki et al.

[11] Patent Number: 4,712,982

[45] Date of Patent: Dec. 15, 1987

[54] VARIABLE DISPLACEMENT WOBBLE PLATE TYPE COMPRESSOR WITH GUIDE MEANS FOR WOBBLE PLATE

[75] Inventors: Mitukane Inagaki; Masaki Ohta; Akihiko Hyodo; Kenji Takenaka; Takashi Mitibata; Shinichi Suzuki; Hiroaki Kayukawa, all of Kariya, Japan

[73] Assignee: Kabushiki Kaisha Toyoda Jidoshokki Seisakusho, Aichi, Japan

[21] Appl. No.: 842,482

[22] Filed: Mar. 21, 1986

[30] Foreign Application Priority Data

Mar. 25, 1985 [JP] Japan ..... 60-60495
Jun. 19, 1985 [JP] Japan ..... 60-133781

[51] Int. Cl.[4] ..... F04B 1/26; F16H 23/00

[52] U.S. Cl. ..... 417/222; 417/269; 92/12.2; 74/60; 184/6.17

[58] Field of Search ..... 417/222, 269, 270; 74/60; 92/12.2; 91/505; 184/6.17

[56] References Cited

U.S. PATENT DOCUMENTS

| | | | |
|---|---|---|---|
| 2,571,312 | 10/1951 | Trevaskis | 417/269 |
| 3,198,022 | 8/1965 | DeWaern | 74/60 |
| 4,297,085 | 10/1981 | Brucken | 417/222 |
| 4,480,964 | 11/1984 | Skinner | 417/222 |

*Primary Examiner*—William L. Freeh
*Assistant Examiner*—Paul F. Neils
*Attorney, Agent, or Firm*—Burgess, Ryan and Wayne

[57] ABSTRACT

A variable displacement wobble plate compressor with a guide unit for a wobble plate, having a cylindrical guide rod axially extending in the compressor in parallel with a compressor drive shaft, a slide slidably and rotatably fitted on the guide rod and provided with lateral pivots on laterally opposite sides thereof which extend in a direction at a right angle to the axis of the guide rod, and a pair of shoes pivotally engaged with the pivots of the slide and slidably received in a radial recess formed in a lowermost portion of the wobble plate. Each of the shoes has a semi-cylindrical outer face complementary with a semi-cylindrical concave wall of the radial recess of the wobble plate so as to permit a relative turning of the wobble plate to the shoes. The slide and shoes may have oil passageways and/or oil grooves.

7 Claims, 11 Drawing Figures

VARIABLE DISPLACEMENT WOBBLE PLATE TYPE COMPRESSOR WITH GUIDE MEANS FOR WOBBLE PLATE

BACKGROUND OF THE INVENTION

1. Field of the Invention

The present invention relates to a variable displacement wobble plate type compressor. More particularly, it relates to an improvement in the guide means for a wobble plate of a variable displacement wobble plate type compressor.

2. Description of the Related Art

A typical variable displacement wobble plate type compressor to be used in a vehicle airconditioning compressor is disclosed in U.S. Pat. No. 4,428,718 to T. J. Skinner. In this compressor, a non-rotating ring shaped wobble plate capable of angulating for causing a reciprocating motion of pistons is supported by a rotatable drive plate, via a thrust needle bearing, and is axially slidably guided by an axially extended guide pin, via a ball guide. The guide pin is press-fitted at opposite ends in a cylinder block having a plurality of cylinders and a crankcase defining therein a chamber for retaining the wobble plate and the drive plate on an axial drive shaft which is operatively connected, at an outer end, to a car engine. The ball guide is retained between semi-cylindrical guide shoes which are slidably mounted for reciprocal radial movement in the wobble plate. The detailed construction of the guide mechanism for the wobble plate of the above-mentioned variable displacement compressor is definitely disclosed in U.S. Pat. No. 4,297,085 to B. L. Brucken. Particularly, FIGS. 3 through 5 of the latter U.S. Patent clearly illustrate the constructional relationship among the guide pin, the ball guide, and the semi-cylindrical guide shoe members. In this connection, it is stated that each of the guide shoe members has a concave semi-spherical recess which is formed in a planar surface of its guide shoe members, respectively, and that each planar surface defines a planar portion, bearing substantially slidably on the guide pin, operative to maintain the guide shoe members in substantially parallel planes. It is true that this construction is able to ensure a stable wobble motion of the wobble plate, but, since each of the above-mentioned planar portions of the shoe members must always slide on the surface of the guide pin while maintaining a substantial point to point contact therebetween, the contact portions of the guide pin and the shoe members must become worn during long-term operation of the compressor. Therefore, it is necessary to lubricate the guide mechanism for the wobble plate, although U.S. Pat. No. 4,297,085 is silent about lubrication of the wobble plate guide mechanism. As a result, the conventional guide mechanism lacks durability in operation.

SUMMARY OF THE INVENTION

An object of the present invention is therefore to obviate the incompleteness of the conventional guide mechanism for a wobble plate of a variable displacement wobble plate type compressor.

Another object of the present invention is to provide a variable displacement compressor with an improved guide mechanism for a non-rotating wobble plate.

A further object of the present invention is to provide a guide mechanism for a compressor wobble plate incorporating therein a lubrication system.

A still further object of the present invention is to provide a variable displacement wobble plate compressor having a long durability in operation.

In accordance with the present invention, there is provided a variable displacement wobble plate type compressor including a compressor head having therein a suction chamber for a refrigerant to be compressed and a discharge chamber for a compressed refrigerant, a cylinder block having therein a plurality of cylinder bores in which associated reciprocatory pistons are disposed so as to draw the refrigerant from the suction chamber and then to discharge the refrigerant after compression to the discharge chamber, a crankcase connected to the cylinder block and receiving therein an axial drive shaft and an assembly of non-rotary wobble and rotatable drive plates mounted on the drive shaft so as to cause a compressing motion of the reciprocatory pistons, a guide means for permitting inclination of the wobble plate from a plane perpendicular to the drive shaft while preventing any rotation of the wobble plate about the drive shaft, and a control means for changing the angle of inclination of the wobble plate so as to vary the compressor displacement in accordance with a refrigerating load. The guide means comprise: a guide rod arranged so as to be axially extended in parallel with the drive shaft in the crankcase; a slide axially slidably and rotatably mounted on the guide rod and having opposite lateral sides thereof; a pair of shoes pivotally and coaxially mounted on the lateral sides of the slide, respectively, so as to axially slide with the slide along the guide rod and to rotate relative to the slide, each of the pair of shoes having, on a laterally outer face thereof, a semi-cylindrical convexed face extending in a direction across a sliding direction of the slide, and a radial slot formed in a part of a periphery of the wobble plate for slidably receiving the pair of shoes, the radial slot having a central opening permitting the guide rod to pass therethrough and a pair of semi-cylindrical concaved and parallel faces on opposite lateral sides and complementary with the semi-cylindrical convexed faces of the shoes while opposing one another.

BRIEF DESCRIPTION OF THE DRAWINGS

Other objects, features and advantages of the present invention will be made more apparent from the ensuing description of the embodiments of the present invention with reference to the accompanying drawings, wherein.

DESCRIPTION OF THE PREFERRED EMBODIMENTS

The following description will be provided for the case where the present invention is embodied by a variable displacement wobble plate type compressor, used for air conditioning a car cabin. That is, the compressor is driven by a car engine via, e.g., a belt-pulley transmission mechanism and a solenoid operated clutch. However, it should be understood that the use of the compressor is not limited to only the air conditioning of a car.

Figure 1:
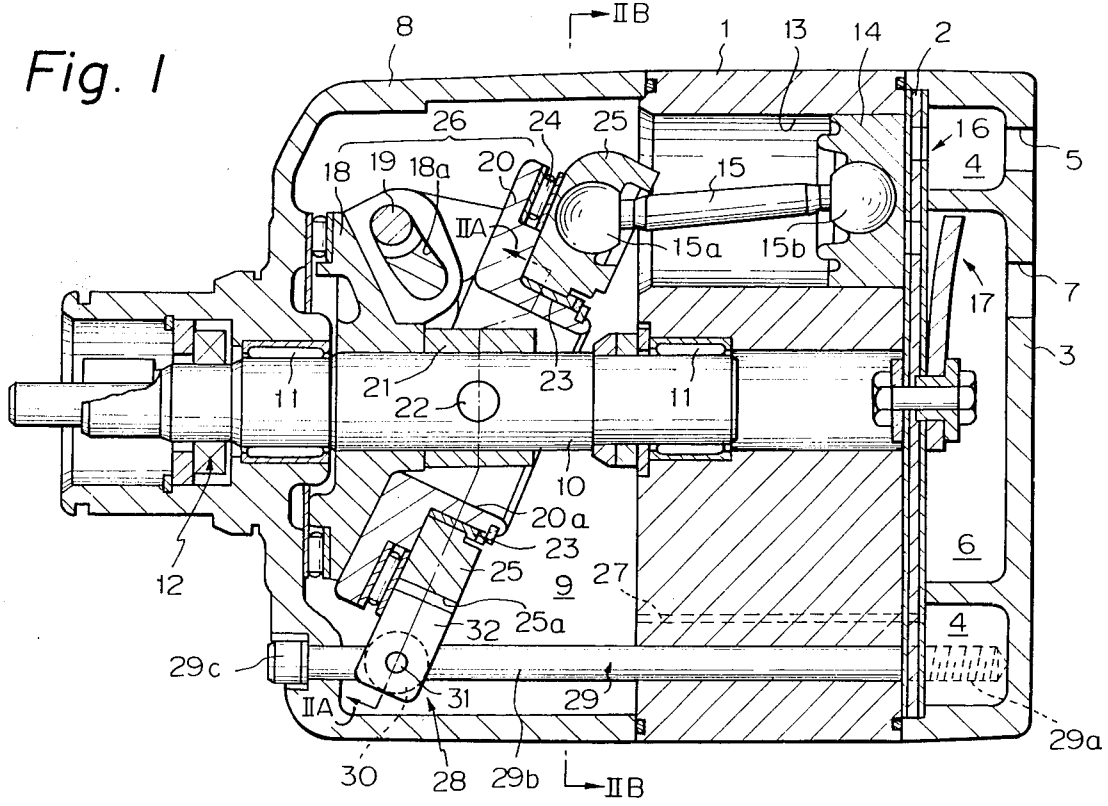
FIG. 1 is a longitudinal cross-sectional view showing a variable displacement wobble plate compressor with a wobble plate guide means, according to the first embodiment of the present invention.

Referring to FIG. 1, a variable displacement wobble plate type compressor includes a cylinder block 1 usually of cylindrical shape, having opposite open ends. One end of the cylinder block 1, i.e., the right open end in the drawing, is sealingly closed, via a valve plate 2, by a compressor head 3 having an annular suction chamber 4 formed with an inlet port 5 which is connected to an outer air conditioning circuit (not illustrated in FIG. 1) so as to receive a refrigerant gas returning from the circuit. The compressor head also has a centrally arranged discharge chamber 6 formed with a discharge port 7 which is also connected to the air conditioning circuit to deliver the refrigerant gas after compression.

The other end of the cylinder block 1, i.e., the left open end in the drawing, is fixedly and sealingly closed by a bell-shaped crankcase 8, having a cylindrical chamber 9 therein. A drive shaft 10 is rotatably mounted in the cylinder block 1 and the crankcase 8 via a pair of radial bearings 11, and is sealed, at an outer end portion thereof, by a conventional sealing mechanism 12. An outermost end of the drive shaft 10 is projected from the crankcase 8 so as to be capable of being drivingly connected to a car engine. The abovementioned compressor head 3, valve plate 2, cylinder block 1, and crankcase 8 are axially combined together by a plurality of lengthy screw bolts 29' and 29 (five screw bolts in the case illustrated in FIGS. 1 and 2B) which are arranged to be extended in parallel with the drive shaft 10 in a plurality of spaces left between neighboring cylinder bores described later.

The cylinder block 1 is formed with a plurality of axial cylinder bores 13 (In the case of the present embodiment, five cylinder bores 13, only one of which appears in FIG. 1, are arranged) which are parallel with the drive shaft 10 and are arranged to be equiangularly spaced apart from one another on a circle about the axis of the drive shaft 10.

Each of the cylinder bores 13 is slidably fitted with a reciprocatory piston 14 having one end, i.e., the left end is FIG. 1, connected to a connecting rod 15 via a ball and socket joint **15*b*. The other end of each piston 14 is a compressing face opposed to the valve plate 2 in which a suction valve mechanism 16 for permitting the refrigerant gas from the suction chamber 4 to enter the cylinder bore 13 during the suction stroke of the piston 14 as well as a discharge valve mechanism 17 for permitting the compressed refrigerant gas from the cylinder bore 13 to enter the discharge chamber 6** are formed.

Figure 2A:
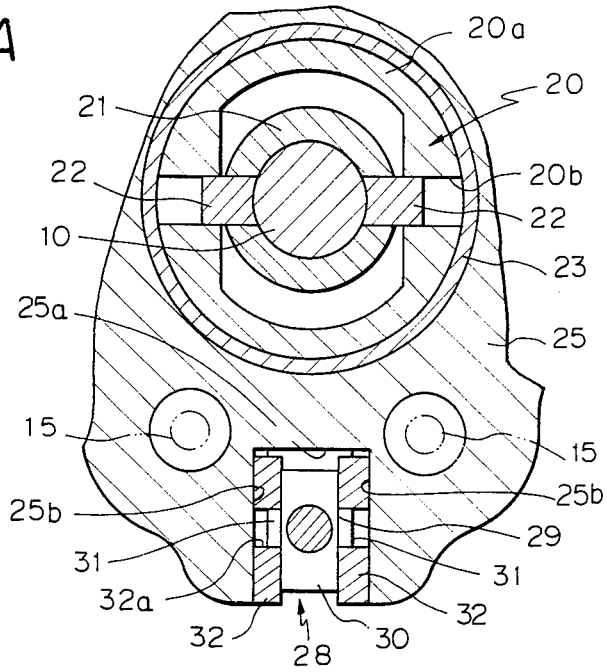
FIG. 2A is a cross-sectional view of a part of the compressor taken along the line IIA—IIA of FIG. 1.
Figure 2B:
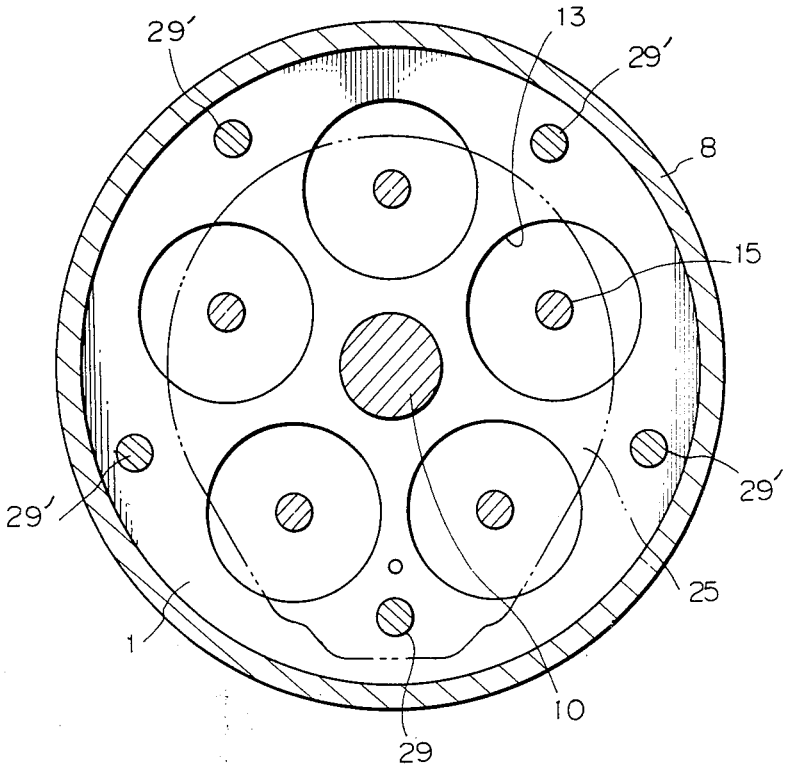
FIG. 2B is a vertical cross-sectional view taken along the line IIB—IIB of FIG. 1.

A drive element 18 is fixedly mounted on the drive shaft 10 so as to be rotatable with the drive shaft 10 relative to the crankcase 8. The drive element 18 has an elongated and slanting through-hole **18*a* in which a laterally extending connecting pin 19 is engaged. The connecting pin 19 per se is fixed to a bracket of a drive plate 20 which is mounted so as to surround the drive shaft 10. Thus, the drive plate 20 is able to rotate with the drive element 18 as well as to wobble about an axis perpendicular to the drive shaft 10. That is, the drive plate 20 is able to carry out an inclining motion with respect to a plane perpendicular to the axis of the drive shaft 10, due to the guidance of the through-hole 18*a*. As illustrated in FIGS. 1 and 2A, the drive shaft 10 has a sleeve element 21 slidably mounted thereon. The sleeve element 21 is provided with a pair of radially extending pins 22 on opposite sides of the element 21. The pins 22 fixed to the sleeve element 21 are engaged in associated radial holes 20*b* formed in a boss 20*a* of the drive plate 20**.

The drive plate 20 supports thereon a wobble plate 25 via a journal bearing 23 mounted on the boss **20*a* of the drive plate 20 and a thrust bearing 24. That is, the wobble plate 25 is able to carry out a wobbling motion with the drive plate 20 under the guidance of a guide unit 28 which prevents the wobble plate 26 from being rotated by the drive plate 20. The wobble plate 25 is connected to the afore-mentioned connecting rods 15 via respective ball and socket joints 15*a*. Thus, when the drive element 18 is rotated by the drive shaft 10 so that the wobbling motion of the drive plate 20 and the wobble plate 25 is caused, the pistons 14 are reciprocated in the associated cylinder bores 13. That is, compressing and pumping motions of the pistons 14 are carried out. The extent of the reciprocating stroke of the respective pistons 14, i.e., the compressor displacement is changed in response to a change in an angle of inclination or wobble of the wobble plate 25, and the wobbling angle of the wobble plate 25 is changed by a pressure difference between the pressure in the chamber 9 of the crankcase 8 and the pressure in the suction chamber 4**. At this stage, the compressor displacement must be changed in compliance with a change in a refrigerating load in the car cabin to be air-conditioned. Thus, the variable displacement wobble plate compressor is provided with a wobble angle control unit; the construction and operation of which is disclosed in, e.g., a copending U.S. application Ser. No. 839,908 assigned to the same assignee as the present application, claiming the priorities of Japanese Patent Applications Nos. 60-056422 and 60-129362, and filed on Mar. 20, 1986. The copending U.S. application is therefore incorporated herein by reference as a part of the disclosure.

In FIG. 1, a rotatable support for the wobble plate 25, formed by the combination of the drive element 18, the connecting pin 19, the drive plate 20, the sleeve element 21, and the pair of radial pins 22 is generally designated by reference numeral 26.

An extraction passageway 27 is provided so as to pass through the cylinder block 1 and the valve plate 2, thereby providing communication between the chamber 9 of the crankcase 8 and the suction chamber 4. By virtue of the provision of the extraction passageway 27, the refrigerant gas sent from the compression chamber of each cylinder bore 13 into the crankcase chamber 9 due to a blowby during operation of the compressor, is returned to the suction chamber 4 so that any pressure increase in the crankcase chamber 9 can be suppressed.

The description of the guide unit 28 for permitting the wobbling motion of the wobble plate 25 while preventing it from being caused to rotate by the rotatable support 26 is provided hereinbelow with reference to FIGS. 1, 2A, 2B, and 3.

Figure 3:
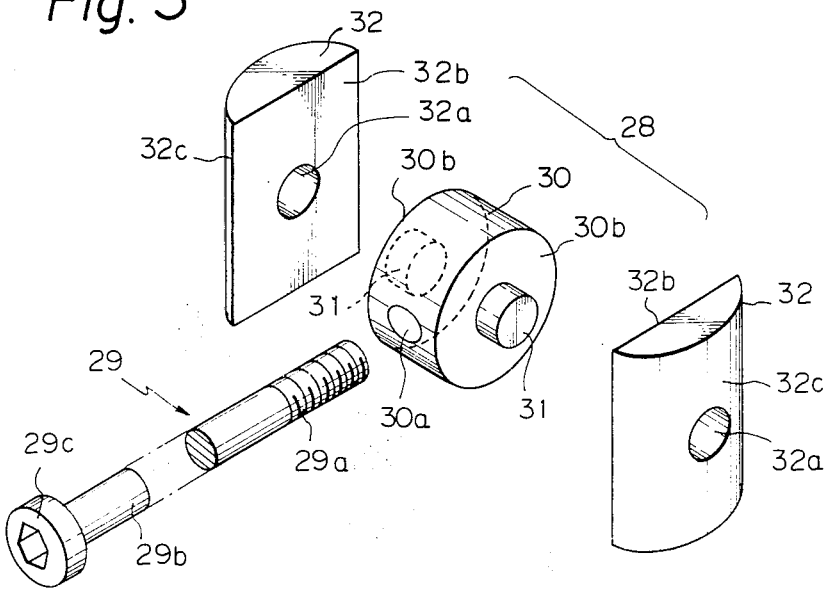
FIG. 3 is an exploded perspective view of a featured portion of a wobble plate guide means accommodated in the compressor of FIG. 1.

A guide rod 29, which is preferably formed as one of the screw bolts 29', is arranged so as to axially extend through the crankcase 8 and the cylinder block 1 in parallel with the drive shaft 10. The guide rod 29 is also arranged so as to pass through an open recess 25*a* radially formed in a lowermost part of the wobble plate 25. The guide rod 29 has a threaded end 29*a* threadedly engaged in the compressor head 3, a cylindrical major portion 29*b* operable as a rigid guide, and a screw head 29*c* seated in the front face of the crankcase 8, as illustrated in FIG. 1. On the cylindrical major portion 29*b* of the guide rod 29 is slidably mounted a slide 30 having a cylindrical body of which the axis extends perpendicularly to the axis of the guide rod 29. The slide 30 is formed with a diametrically extending bore 30*a*, by which it is slidably and rotatably fitted on the above-mentioned guide rod 29. The slide 30 has opposite lateral ends 30*b* from which cylindrical pivots 31 project laterally, i.e., in a direction at a right angle to the axis of the guide rod 29, as best shown in FIG. 3. The cylindrical pivots 31 preferably formed to be integral with the cylindrical body are pivotally fitted in holes 32*a* of shoes 32 arranged laterally on both sides of the slide 30. That is, the shoes 32 are rotatable about the pivots 31 of the slide 30. Each of the shoes 32 is formed with a flat inner face 32*b* kept in contact with the confronting lateral end 30*b* of the slide 30 and with a semi-cylindrical convexed outer face 32*c* extending up and down with respect to the hole 32*a*, i.e., in a direction across the axis of the guide rod.

On the other hand, the radial recess 25*a* of the wobble plate 25 has a pair of semi-cylindrical concaved and radially inwardly extending inner walls 25*b* laterally opposed to one another across a space for receiving therein the above-mentioned guide rod 29, the slide 30, and the pair of shoes 32, as best illustrated in FIG. 2A. That is, the semi-cylindrical concaved inner walls 25*b* are complemental with the semi-cylindrical convexed outer faces 32*c* of the shoes 32, and permit the shoes 32 to slide in a relatively radial direction of the wobble plate 25. Further, the complemental engagement of the semi-cylindrically concaved inner walls 25*b* of the recess 25*a* of the wobble plate 25 and the semi-cylindrically convexed outer faces 32*c* c of the shoes 32 also permits the wobble plate 25 per se to relatively turn along the faces 32*c* of the shoes 32 during the wobbling of the wobble plate 25.

It should be noted that in the guide unit 28 of the present embodiment, the guide rod 29 and the shoes 32 are both made of ferrous material, and that the slide 30 is made of high silicon aluminum alloy (e.g., A 390) having a high abrasion resistant property but softer than the ferrous material of the guide rod 29. It should be also noted that the guide rod 29 is arranged so as to be used not only as a wobble plate guide but also as one of the combining screw bolts 29'. Thus, the guide rod 29 is subjected to tension, due to reaction of the combining operation. This tension is effective for enhancing a resistance of the guide rod to a bending force acting on the rod 29 during the wobble motion of the wobble plate 25. Moreover, mounting of the guide rod 29 by the threaded engagement of the portion 29*a* to the compressor head 3 can be effective for simplifying the assembling of the compressor per se.

It should further be noted that since the guide unit 28 is disposed in the lowermost part of the crankcase chamber 9, the slide 30 and the shoes 32 of the unit 28 can be lubricated by lubricating oil retained in the chamber 9 of the crankcase 8 (the compressor is usually disposed in an engine compartment so that the axis of the drive shaft is almost horizontal).

Figure 4:
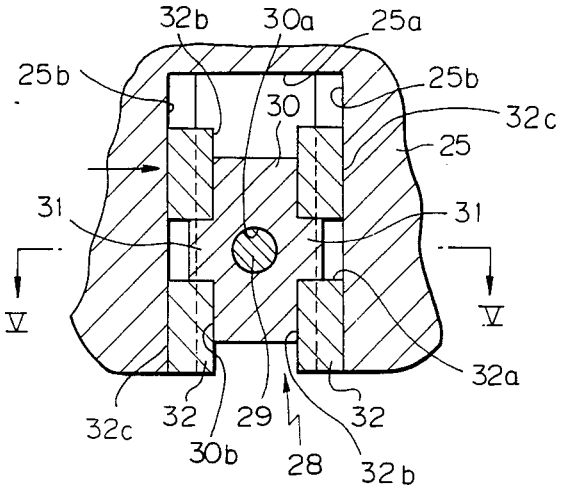
FIG. 4 is an enlarged cross-sectional and partial view of the wobble plate guide means of FIG. 3.

The operation of the variable displacement wobble plate type compressor shown in FIGS. 1 through 3 is now described hereinbelow with reference to FIGS. 4 through 6 in addition to FIGS. 1 through 3.

When the drive shaft 10 is driven by a car engine, the rotatable support 26 is rotated so as to cause the wobbling motion of the wobble plate 25 under the guidance of the wobble plate guiding unit 28. Thus, the pistons 14 are reciprocated in the cylinder bores 13 by the wobble plate 25 via the connecting rods 15. As a result, the refrigerant gas is drawn from the suction chamber 4 into the compression chambers of the cylinder bores 13 via the suction valve mechanism 16, and then is subjected to compression by the pistons 14. The compressed gas is thereafter discharged through the discharge valve mechanism 17 into the discharge chamber 6.

The refrigerant gas leaking out of the compression chamber into the crankcase chamber 9 due to a blowby is returned to the suction chamber 4 through the extraction passageway 27.

During the initial stage of the operation of the compressor, when the temperature in a car cabin to be air-conditioned is relatively high, i.e., when a refrigerating load is large, gas pressure in the crankcase chamber 9 is slightly higher than the suction pressure of the compressor, and a pressure difference between both gas pressures is maintained to be smaller than a predetermined pressure value. Therefore, the pistons 14 carry out a reciprocating motion at their maximum strokes and perform a full displacement operation. That is, the angle of wobble of the wobble plate 25 is at the maximum.

During the running of the compressor, when the temperature of the car cabin is lowered, resulting in a decrease in the refrigerating load, the suction pressure of the compressor drops. As a result, the abovementioned pressure difference becomes large. Accordingly, the angle of wobble of the wobble plate 25 is decreased. Thus, the pistons 14 carry out a reciprocating motion at their reduced strokes and perform a small displacement operation. While the wobble plate 25 wobbles about the connecting pin 19, the position and posture of the wobble plate change under the guidance of the guide unit 28. That is, due to the complementary engagement of the semi-cylindrical concaved inner walls 25*b* of the wobble plate 25 and the semicylindrical convexed outer faces 32*c* of the shoes 32, and also due to the pivotal engagement of the shoes 32 and the pivots 31 of the slide 30, the wobble plate 25 is permitted to slide along the guide rod 29 via the slide 30, as well as to change its inclination with respect to a plane perpendicular to the axis of the drive shaft 10. It should be understood that the shoes 32 move relatively to the wobble plate 25 in the open recess 25*a* of the wobble plate 25 by sliding on the semi-cylindrical concaved inner walls 25*b*. Further, while the wobble plate 25 is wobbling, a force is applied from the rotating rotatable support 26 to the wobble plate 25 so as press it against the shoes 32 as illustrated by an arrow in FIG. 4. However, since the slide 30 is rotatable about the guide rod 29, and since the semi-cylindrical concaved inner walls 25*b* are relatively movable to the complementary outer faces 32*c* of the shoes 32, a tight contact between the abovementioned walls 25*b* and faces 32*c* does not occur. Accordingly, the occurrence of any unfavorable local abrasion of the relative movement elements can be prevented.

Figure 5:
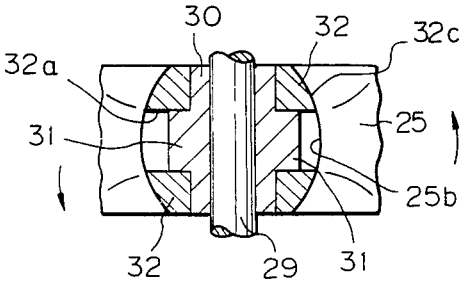
FIG. 5 is a cross-sectional view taken along the line V—V of FIG. 4.
Figure 6:
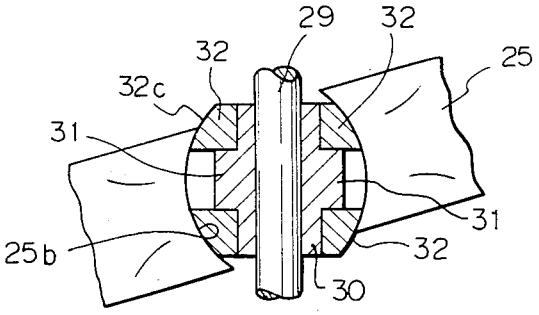
FIG. 6 is the same view as that of FIG. 5, illustrating an operational state of the wobble plate guide means of FIG. 3.

Further, while the wobble plate 25 is wobbling, it is subjected to a twisting force as illustrated in FIG. 5. However, the afore-mentioned complementary engagement between the semi-cylindrical concaved walls 25*b* of the wobble plate 25 and the semi-cylindrical convexed faces 32*c* of the shoes 32 prevents the occurrence of any bending of the guide rod 29 by that twisting force. FIG. 6 illustrates a state in which only the wobble plate 25 is relatively moved by the influence of the twisting force so as to avoid transmission of the twisting force to the guide rod 29.

Figure 7:
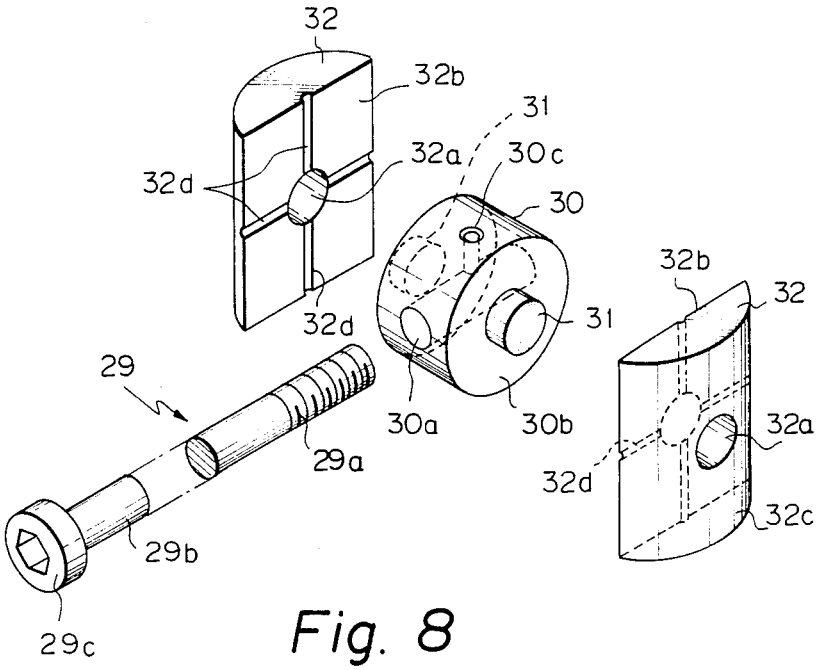
FIG. 7 is an exploded view of a variant of the wobble plate guide means, capable of being accommmodated in the compressor of the present invention.
Figure 8:
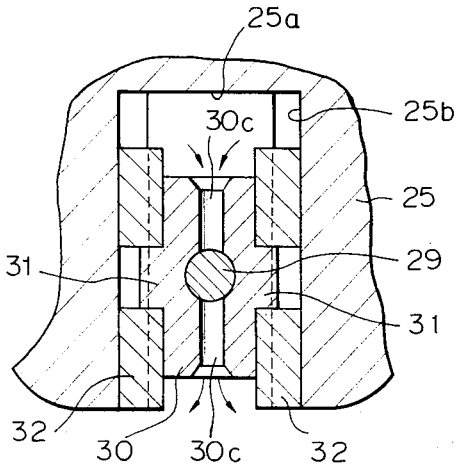
FIG. 8 is an enlarged cross-sectional and partial view of the guide means of FIG. 7.

FIGS. 7 and 8 illustrate a variant of the guide unit 28 in which an improvement in a lubricating system for lubricating the guide rod 29, the slide 30, and the shoes 32 is implemented. As is easily understood, the slide 30 is provided with an oil passageway 30*c* for facilitating the introduction of a lubricating oil into the diametrically extending bore 30*a* as well as onto the cylindrical portion 29*b* of the guide rod 29. Additionally, each of the shoes 32 is formed with crossing oil grooves 32*d* in the inner flat face 32*b* so that the lubricating oil is supplied to the contacting faces 30*b* and 32*b* of the slide 30 and the shoes 32. As illustrated in FIG. 8, while the wobbling plate 25 is wobbling and sliding along the guide rod 29, a change in spacing occurs between the slide 30 and the innermost face of the recess 25*a* of the wobble plate 25. This change in the spacing causes a pumping action for forcibly introducing the lubricating oil into the oil passageway 30*c* thereby increasing the lubricating efficiency. Consequently, a long durability in operation of the guiding unit for the wobble plate can be ensured.

Figure 9:
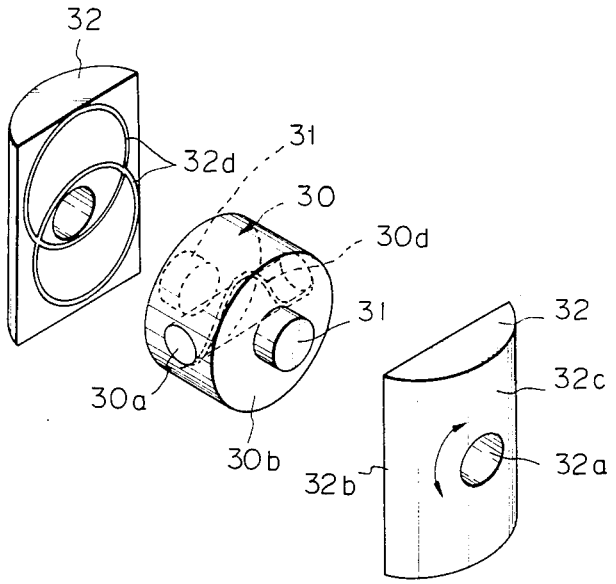
FIG. 9 is an exploded view of another variant of the wobble plate guide means capable of being accommodated in the compressor of the present invention.

FIG. 9 illustrates a further variant of the slide 30 and the shoes 32. The slide 30 of FIG. 9 is formed, in the wall of the cylindrical extending bore 30*a*, with a spiral oil groove 30*d*. The oil groove 30*d* can contribute to a supply of the lubricating oil in the portion of the slide bore 30*a* in contact with the cylindrical portion 29*b* of the guide rod 29.

Each of the shoes 32 is formed, at the inner flat face 32*b* thereof, with an appropriate number of circular oil retaining grooves 32*d* for maintaining a wet condition at the portion of the faces 32*b* of the shoes 32 in contact with both ends 30*b* of the slide 30. The oil retaining grooves 32*d* are also effective for lubricating the pivots 31 of the slide 30 about which the shoes 32 pivot during the wobbling of the wobble plate 25 (see FIG. 1).

Figure 10:
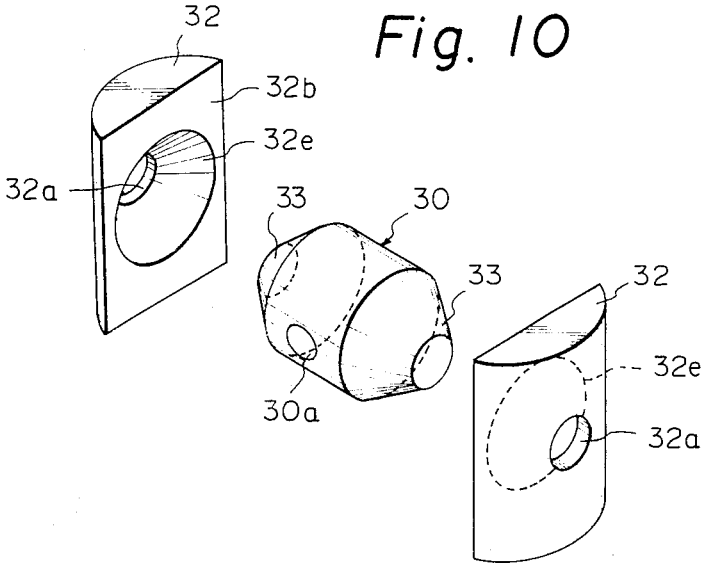
FIG. 10 is an exploded view of a further variant of the wobble plate guide means capable of being accommodated in the compressor of the present invention.

FIG. 10 illustrates a modification of the slide and the shoes. In this modification, the slide 30 is provided, on each side, with a conical convergent end 33 in place of the pivots 31 of the previously described slide 30. Accordingly, each of the shoes 32 is formed with a conical convergent recess 32*e* which is complementary with the conical convergent end 33 of the slide 30.

From the foregoing description of the preferred embodiments of the present invention, it will be understood that, according to the present invention, an improved guide means for guiding the wobbling motion of the non-rotating wobble plate is provided. That is, any one of the wobble plate, the guide rod, the slide, and the shoes will not be subjected to unfavourable local abrasion and seizure. Thus, a long operation life of the wobble plate as well as the guide means of the wobble plate can be guaranteed. Further, provision of the oil lubricating system for the wobble plate guide means enhances the operation life of the guide means and therefore, the operation life of the variable displacement wobble plate type compressor.

It should be understood that various modifications and variations will further occur to a person skilled in the art without departing from the scope of the appended claims.

We claim:

1. A variable displacement wobble plate type compressor including a compressor head having therein a suction chamber for a refrigerant to be compressed and a discharge chamber for a compressed refrigerant, a cylinder block having therein a plurality of cylinder bores in which associated reciprocatory pistons are disposed so as to draw the refrigerant from the suction chamber and then to discharge the refrigerant after compression to the discharge chamber, a crankcase connected to the cylinder block and receiving therein an axial drive shaft and an assembly of non-rotary wobble and rotatable drive plates mounted on the drive shaft so as to cause compressing motion of the reciprocatory pistons, a guide means for permitting inclination of the wobble plate from a plane perpendicular to the drive shaft while preventing any rotation of the wobble plate about the drive shaft, and a control means for changing an angle of inclination of the wobble plate so as to vary compressor displacement in association with a refrigerating load, wherein said guide means comprise:

a guide rod having a cylindrical extended major portion arranged so as to be axially extended in parallel with said drive shaft in said crankcase;

a slide axially slidable and rotatably mounted on said cylindrical extended major portion of the guide rod and having opposite lateral ends thereof, the slide having a pivot on each of the lateral outer ends thereof extending at a right angle to the guide rod;

a pair of shoes pivotally and coaxially mounted on said lateral ends of said slide, respectively, so as to axially slide with said slide along said guide rod and to rotate relative to said slide, each of said pair of shoes having, on a laterally outer face thereof, a semi-cylindrical convexed face extending in a direction across a sliding direction of said slide, each shoe having a through-hole rotatably fitting on each pivot of the slide; and a radial slot formed in a part of a periphery of said wobble plate for slidably receiving said pair of shoes, said radial slot having a central opening permitting said guide rod to pass therethrough and a pair of semi-cylindrical convexed faces of said shoes while opposing one another.

2. A variable displacement compressor according to claim 1, wherein said guide rod is made of ferrous material, and wherein said slide is made of high silicon aluminum alloy softer than the ferrous material of said guide rod having abrasion resistant property.

3. A variable displacement compressor according to claim 1, wherein said laterally outer ends of said slide are flat surfaces in contact with flat faces formed in respective lateral inner faces of said pair of shoes.

4. A variable displacement compressor according to claim 3, wherein said flat faces of said shoes are respectively provided with at least an oil groove for introducing lubricating oil into portions of said flat surfaces of said slide in contact with said flat faces of said pair of shoes.

5. A variable displacement wobble plate type compressor including a compressor head having therein a suction chamber for a refrigerant to be compressed and a discharge chamber for a compressed refrigerant, a cylinder block having therein a plurality of cylinder bores in which associated reciprocatory pistons are disposed so as to draw the refrigerant from the suction chamber and then to discharge the refrigerant after compression to the discharge chamber, a crankcase connected to the cylinder block and receiving therein an axial drive shaft and an assembly of non-rotary wobble and rotatable drive plates mounted on the drive shaft so as to cause compressing motion of the reciprocatory pistons, a guide means for permitting inclination of the wobble plate from a plane perpendicular to the drive shaft while preventing any rotation of the wobble plate about the drive shaft, and a control means for changing an angle of inclination of the wobble plate so as to vary compressor displacement in association with a refrigerating load, wherein said guide means comprise:

a guide rod having a cylindrical extended major portion arranged so as to be axially extended in parallel with said drive shaft in said crankcase;

a slide having an axial bore, the slide axially slidably and rotatably mounted on said cylindrical extended major portion of the guide rod and having opposite lateral ends thereof, the slide having an oil lubricating passageway therein, for introducing lubricant in the axial bore whereby the cylindrical extended major portion of the guide rod is lubricated;

a pair of shoes pivotally and coaxially mounted on said lateral ends of said slide, respectively, so as to axially slide with said slide along said guide rod and to rotate relative to said slide guide rod and to rotate relative to said slide, each of said pair of shoes having, on a laterally outer face thereof, a semi-cylindrical convexed face extending in a direction across a sliding direction of said slide; and a radial slot formed in a part of a periphery of said wobble plate for slidably receiving said pair of shoes, said radial slot having a central opening permitting said guide rod to pass therethrough and a pair of semi-cylindrical concaved and parallel faces on opposite lateral sides and complementary with said semi-cylindrical convexed faces of said shoes while opposing one another, 6. A variable displacement wobble plate type compressor including a compressor head having therein a suction chamber for a refrigerant to be compressed and a discharge chamber for a compressed refrigerant, a cylinder block having therein a plurality of cylinder bores in which associated reciprocatory pistons are disposed so as to draw the refrigerant from the suction chamber and then to discharge the refrigerant after compression to the discharge chamber, a crankcase connected to the cylinder block and receiving therein an axial drive shaft and an assembly of non-rotary wobble and rotatable drive plates mounted on the drive shaft so as to cause compressing motion of the reciprocatory pistons, a guide means for permitting inclination of the wobble plate from a plane perpendicular to the drive shaft while preventing any rotation of the wobble plate about the drive shaft, and a control means for changing an angle of inclination of the wobble plate so as to vary compressor displacement in association with a refrigerating load, wherein said guide means comprise:

a guide rod having a cylindrical extended major portion arranged so as to be axially extended in parallel with said drive shaft in said crankcase;

a slide having an axial bore, the slide axially slidably and rotatably mounted on said cylindrical extended major portion of the guide rod and having oposite lateral ends thereof, the slide having at least an oil groove formed in a surface of the axial bore for introducing lubricating oil in said axial bore whereby the cylindrical extended major portion of the guide rod is lubricated;

a pair of shoes pivotally and coaxially mounted on said lateral ends of said slide, respectively, so as to axially slide with said slide along said guide rod and to rotate relative to said slide, each of said pair of shoes having, on a laterally outer face thereof, a semi-cylindrical convexed face extending in a direction across a sliding direction of said slide; and a radial slot formed in a part of a periphery of said wobble plate for slidably receiving said pair of shoes, said radial slot having a central opening permitting said guide rod to pass therethrough and a pair of semi-cylindrical concaved and parallel faces on opposite lateral sides and complementary with said semi-cylindrical convexed faces of said shoes while opposing one another.

7. A variable displacement wobble plate type compressor including a compressor head having therein a suction chamber for a refrigerant to be compressed and a discharge chamber for a compressed refrigerant, a cylinder block having therein a plurality of cylinder bores in which associated reciprocatory pistons are disposed so as to draw the refrigerant from the suction chamber and then to discharge the refrigerant after compression to the discharge chamber, a crankcase connected to the cylinder block and receiving therein an axial drive shaft and an assembly of non-rotary wobble and rotatable drive plates mounted on the drive shaft so as to cause compressing motion of the reciprocatory pistons, a guide means for permitting inclination of the wobble plate from a plane perpendicular to the drive shaft while preventing any rotation of the wobble plate about the drive shaft, and a control means for changing an angle of inclination of the wobble plate so as to vary compressor displacement in association with a refrigerating load, wherein said guide means comprise:

a guide rod having a cylindrical extended major portion arranged so as to be axially extended in parallel with said drive shaft in said crankcase;

a slide having an axial bore, the slide axially slidably and rotatably mounted on said guide rod and having opposite lateral conical convergent ends exiting at a right angle to the guide rod;

a pair of shoes pivotally and coaxially mounted on said lateral ends of said slide, respectively, so as to axially slide with said slide along said guide rod and to rotate relative to said slide, each of said pair of shoes having, on a laterally outer face thereof, a semi-cylindrical convexed face extending in a direction across a sliding direction of said slide, each of the shoes having a conical convergent recess complimentary with and rotatably fitting with each of the conical convergent ends of the slide; and a radial slot formed in a part of a periphery of said wobble plate for slidably receiving said pair of shoes, said radial slot having a central opening permitting said guide rod to pass therethrough and a pair of semi-cylindrical concaved and parallel faces on opposite lateral sides and complementary with said semi-cylindrical convexed faces of said shoes while opposing one another.

* * * * *